US010119432B2

(12) United States Patent
Schulze et al.

(10) Patent No.: US 10,119,432 B2
(45) Date of Patent: Nov. 6, 2018

(54) HYDRAULIC VALVE AND CAM PHASER

(71) Applicant: Hilite Germany GmbH, Marktheidenfeld (DE)

(72) Inventors: Dietmar Schulze, Muenzenberg (DE); Christian Scheibe, Rottenburg (DE)

(73) Assignee: Hilite Germany GmbH, Marktheidenfeld (DE)

( * ) Notice: Subject to any disclaimer, the term of this patent is extended or adjusted under 35 U.S.C. 154(b) by 69 days.

(21) Appl. No.: 14/834,689

(22) Filed: Aug. 25, 2015

(65) Prior Publication Data

US 2016/0032792 A1 Feb. 4, 2016

Related U.S. Application Data

(63) Continuation of application No. PCT/EP2014/055233, filed on Mar. 17, 2014.

(30) Foreign Application Priority Data

May 3, 2013 (DE) ..... 10 2013 104 575

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426; F16K 31/122; Y10T 137/86702
USPC ..... 123/90.17, 90.18; 137/625.68
See application file for complete search history.

(56) References Cited

U.S. PATENT DOCUMENTS

| | | | | |
|---|---|---|---|---|
| 8,684,038 | B2 * | 4/2014 | Schudt | F16K 31/0613 137/625.68 |
| 9,021,997 | B2 * | 5/2015 | Welte | F01L 1/3442 123/90.15 |
| 9,157,343 | B2 * | 10/2015 | Kobayashi | F01L 1/344 |
| 9,394,809 | B2 * | 7/2016 | Gruber | F01L 1/3442 |
| 9,422,838 | B2 * | 8/2016 | Kohler | F01L 1/3442 |
| 2011/0220046 | A1 * | 9/2011 | Welte | F01L 1/3442 123/90.15 |
| 2012/0048398 | A1 * | 3/2012 | Schudt | F16K 31/0613 137/514 |

* cited by examiner

*Primary Examiner* — Eric Keasel
(74) *Attorney, Agent, or Firm* — Von Rochrscheidt Patents

(57) ABSTRACT

A hydraulic valve for a cam phaser, the hydraulic valve including a bushing element, including a longitudinal channel, a first transversal channel originating from the longitudinal channel, a second transversal channel originating from the longitudinal channel, a pressure balanced hollow piston arranged within the longitudinal channel axially moveable between a first end position and a second end position, wherein the longitudinal channel includes a first channel section with a larger inner diameter and a second channel section with a smaller inner diameter, wherein the first transversal channel originates from the first channel section and the second transversal channel originates from the second channel section, wherein the hollow piston includes a longitudinal channel with an axial opening, at least one transversal channel, a first piston section with a greater outer diameter and a second piston section with a smaller outer diameter.

11 Claims, 2 Drawing Sheets

HYDRAULIC VALVE AND CAM PHASER

RELATED APPLICATIONS

This application is a continuation of International Patent application PCT/EP2014/055233 filed on Mar. 17, 2014 claiming priority from German patent application DE 10 2013 104 575 8 filed on May 3, 2013.

FIELD OF THE INVENTION

The invention relates to a hydraulic valve for a cam phaser, the hydraulic valve including a bushing element with a longitudinal channel, a first transversal channel originating from the longitudinal channel and a second transversal channel originating from the longitudinal channel and a pressure balanced hollow piston arranged axially moveable within the longitudinal channel between a first end position and a second end position, the longitudinal channel including a first channel section with a larger inner diameter and a second channel section with a smaller longitudinal diameter, wherein the first transversal channel originates from the first channel section and the second transversal channel originates from the second channel section, the hollow piston including a longitudinal channel with an axial opening, at least one transversal channel, a first piston section with a greater outer diameter and a second piston section with a smaller outer diameter, wherein the hollow piston is supported with a sealing tolerance with its first piston section at the first channel section of the longitudinal channel and supported with sealing tolerance with its second piston section at the second channel section of the longitudinal channel and a cam phaser.

BACKGROUND OF THE INVENTION

The German patent application DE 10 2012 106 096.7 discloses a cam phaser with a hydraulic valve which includes a bore hole with shoulders and operating connections originating from the bore hole with shoulders, wherein a pressure balanced hollow piston is arranged axially moveable within the bore hole and moveable with a sealing tolerance with a first outer diameter within a bore hole section wherein the hollow piston includes an enveloping surface with a large outer diameter adjacent to the first outer diameter in an axial portion of the first operating connection and an enveloping surface with a small outer diameter in the portion of the other operating connection, wherein a respective inlet edge and a respective outlet edge originate from the two enveloping surfaces wherein the two inlet edges are oriented away from each other and the outlet edges are oriented towards each other so that a supply pressure introduced into a cavity of the hollow piston is provided on one side at a projected circular surface which is formed by the small outer diameter so that a force is provided in an axial direction, whereas the supply pressure is provided on one side at a projected annular surface which is formed by the large outer diameter minus the first outer diameter in order to provide a cam phaser with a hydraulic valve where the two operating connections are adjacent to the pressure medium connection on a common axial side.

Further information regarding features of the present invention can be derived from the German patent application DE 10 2012 106 096.7 which is incorporated in its entirety by this reference. Teachings of this patent application are incorporated into the instant document in their entirety. Features of this application are features of the instant document.

BRIEF SUMMARY OF THE INVENTION

It is an object of the invention to improve the hydraulic valve recited supra from a configurational and/or a functional point of view. In particular manufacturing complexity in particular of the hollow piston shall be reduced. In particular a flow resistance shall be reduced. In particular an at least substantially rotation symmetrical configuration of the hollow piston shall be obtained. In particular bevels shall be avoided.

The object is achieved by a hydraulic valve for a cam phaser, the hydraulic valve including a bushing element with a longitudinal channel, a first transversal channel originating from the longitudinal channel and a second transversal channel originating from the longitudinal channel and a pressure balanced hollow piston arranged axially moveable within the longitudinal channel between a first end position and a second end position, the longitudinal channel including a first channel section with a larger inner diameter and a second channel section with a smaller longitudinal diameter, wherein the first transversal channel originates from the first channel section and the second transversal channel originates from the second channel section, the hollow piston including a longitudinal channel with an axial opening, at least one transversal channel, a first piston section with a greater outer diameter and a second piston section with a smaller outer diameter wherein the hollow piston is supported with a sealing tolerance with its first piston section at the first channel section of the longitudinal channel and supported with sealing tolerance with its second piston section at the second channel section of the longitudinal channel, wherein the hollow piston includes plural first pressure surfaces for loading the hollow piston in a direction towards the first end position and plural second pressure surfaces for loading the hollow piston in a direction towards the second end position and a total surface of the first pressure surfaces at least approximately corresponds to a total surface of the second pressure surfaces.

The hydraulic valve can be used for controlling an adjustment of cam phaser. The hydraulic valve can include a first operating connection. The hydraulic valve can include a second operating connection. The hydraulic valve can include a tank connection. The hydraulic valve can be actuatable using an electromagnetic actuator. The hydraulic valve can be a 4/2-way valve. The hydraulic valve can be a proportional valve. The hydraulic valve can include a longitudinal axis.

The bushing element can have a hollow cylindrical shape. The longitudinal channel of the bushing element can extend along the longitudinal axis. The longitudinal channel can include a first end and a second end. The longitudinal channel can include a first axial opening and a second axial opening. The first channel section and the second channel section can be arranged in an axial sequence. The longitudinal channel can include essentially two inner diameters. The inner diameter of the first channel section can be greater than the inner diameter of the second channel section. The inner diameter of the second channel section can be smaller than the inner diameter of the first channel section.

The hollow piston can be moveable in an extension of the longitudinal axis. The hollow piston can have a hollow cylindrical shape. The longitudinal channel of the hollow piston can have a first end and a second end. The longitudinal channel of the hollow piston can have an axial opening. The longitudinal channel can be closed on one side. The longitudinal channel of the hollow piston can be closed at an end that is arranged opposite to the opening. The first piston section and the second piston section can be arranged in a direct axial sequence. The first piston section can be arranged at the side of a longitudinal channel opening. The hollow piston can include essentially two different outer diameters. The outer diameter of the first piston section can be greater than the outer diameter of the second piston section. The outer diameter of the second piston section can be smaller than the outer diameter of the first piston section.

The first piston section can have an annular rib shape. The first piston section can include at least one control edge. The at least one control edge of the first piston section can be used for controlling a flow through the first transversal channel of the bushing element. The second piston section can have an annular rib shape. The second piston section can includes at least one control edge. The at least one control edge of the second piston section can be used for controlling a flow through the second transversal channel of the bushing element.

In the first end position of the hollow piston a pass through between the axial opening and the first transversal channel can be closed. In the first end position of the hollow piston a pass through between the axial opening and the second transversal channel can be open. In the second end position of the hollow piston a pass through between the axial opening and the first transversal channel can be open. In the second end position of the hollow piston a pass through between the axial opening and the second transversal channel can be closed.

The pressure surfaces of the hollow piston can be respective axial pressure surfaces. The pressure surfaces of the hollow piston can be respectively arranged at a right angle relative to the longitudinal axis. The pressure surfaces of the hollow piston can respectively have an annular shape. The first pressure surfaces can be oriented towards the open end of the longitudinal channel. The second pressure surfaces can be oriented towards a closed end of a longitudinal channel. A total surface can be a sum of surfaces. The hollow piston can include three first pressure surfaces and two second pressure surfaces.

The hollow piston can include a third radially recessed piston section axially between the first piston section and the second piston section in order to form an annular cavity and the at least one transversal channel can connect the annular cavity with the longitudinal channel. The hollow piston can include a step at its third piston section. The step can be rectangular. The step can form a pressure surface.

The hollow piston can include a first pressure surface at a face oriented towards the opening, a second pressure surface at the first piston section, a second pressure surface at the shoulder of the third piston section, a first pressure surface at the second piston section and a first pressure surface at the closed end of the longitudinal channel. The hollow piston can have pressure surfaces at the annular cavity formed with the third piston sect on. The hollow piston can have pressure surfaces at its longitudinal channel.

The bushing element can have an axial Opening and initially the first transversal channel and thereafter the second transversal channel can be arranged originating from the opening. Between the opening of the bushing element and the first transversal channel a third transversal channel can be arranged. A check valve can be arranged in the opening of the bushing element. The check valve can open in an inlet direction and close in an outlet direction. An inlet direction can be oriented from an outside into the longitudinal channel. An outlet direction can be oriented from the longitudinal channel in outward direction. The check valve can be openable and/or closable self-acting as a function of a pressure medium flow.

A pressure connection can be associated with the opening of the bushing element. A first operating connection can be associated with the first transversal channel, a second operating connection can be associated with the second transversal channel and a tank connection can be associated with the third transversal channel. The pressure medium connection can be an axial connection. The operating connections and the tank connection can include axes that are perpendicular to the longitudinal axis. The operating connections and the tank connection can be radial connections. An operating connection can be configured for a flow through in both flow through directions.

The object of the invention is furthermore achieved by a cam phaser with a stator and a rotor that is rotatable relative to the stator between a first end position and a second end position for adjusting a cam shaft of an internal combustion engine wherein the cam phaser includes a hydraulic valve of the type recited supra for controlling a rotation of the rotor.

The actuator can be a cam phaser. The internal combustion engine can include a drive shaft like e.g. a crank shaft. The internal combustion engine can include at least one cam shaft. The internal combustion engine can include valves. The at least one cam shaft can be used for actuating the valves. The internal combustion engine can used for driving the motor vehicle. The cam phaser can be used for arrangement in a valve train of the internal combustion engine between the drive shaft and the at least cam shaft. The cam phaser can be used for adjusting a relative rotational position between the drive shaft and the at least one cam shaft. The cam phaser can be used for phasing the cam shaft. The cam phaser can be used for adjusting valves timing. The cam phaser can be used for an adjustment in a direction early and/or late. "Early" can mean that the valves of the internal combustion engine are opened and/or closed early with respect to a rotational position of the drive shaft. "Late" can mean that the valves of the internal combustion engine are opened and/or closed late with respect to a rotational position of the drive shaft. The cam phaser can have a rotational axis about which the stator and the rotor are rotatable together and/or relative to each other.

"Can" designates in particular optional features of the invention. Therefore there is a respective embodiment of the invention which includes the respective feature or the respective features.

The invention reduces a manufacturing complexity in particular of the hollow piston. A flow resistance is reduced. An at least substantially rotation symmetrical configuration in particular of the hollow piston is obtained. Bevels are avoided.

BRIEF DESCRIPTION OF THE DRAWINGS

Subsequently an embodiment of the invention is described in more detail with reference to drawing figures. This description includes additional features and advantages. Particular features of this embodiment can represent general features of the invention. Features of this particular embodiment that are associated with other features can also represent individual features of the invention, wherein.

DETAILED DESCRIPTION OF THE INVENTION

Figure 1:
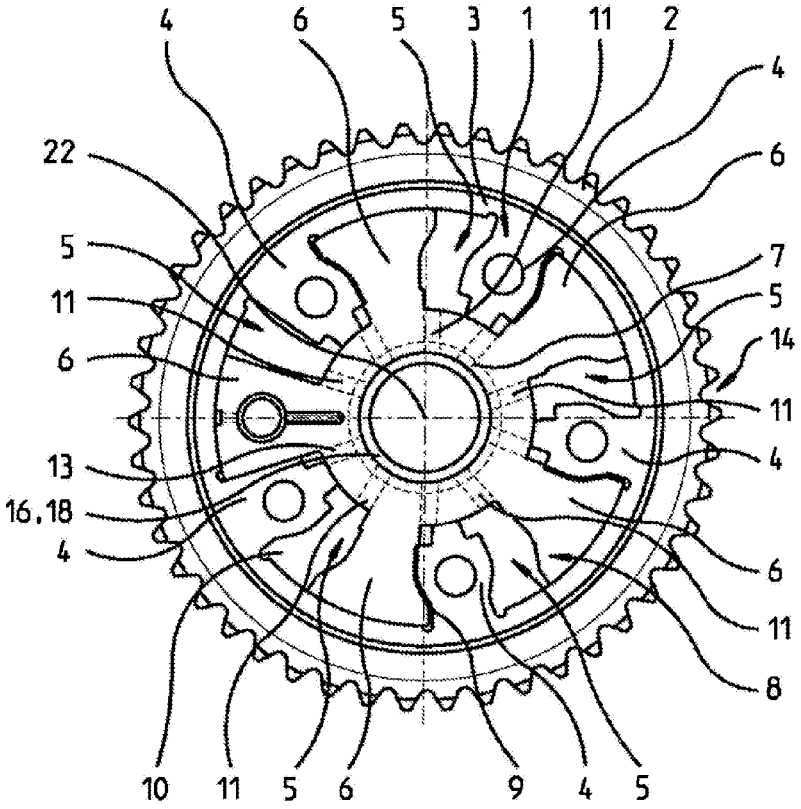
FIG. 1 illustrates a sectional view of a cam phaser.

A cam phaser 14 according to FIG. 1 is used for adjusting an angular position of a cam shaft 18 relative to a drive gear 2 during operation of an internal combustion engine in a continuously variable manner. Rotating the cam shaft 18 moves the opening and closing times of the gas control valves so that the internal combustion engine delivers optimum power at a respective speed. The cam phaser 14 includes a cylindrical stator 1 which is connected torque proof with the drive gear 2. In the embodiment the drive gear 2 is a chain sprocket over which a chain is run that is not illustrated in detail. The drive gear 2, however, can also be a timing belt cog over which a drive belt is run as a drive element. The stator 1 is operatively connected with the crank shaft through this drive element and the drive gear 2.

The stator 1 includes a cylindrical stator base element 3 at whose inside bars 4 extend in radially inward direction in uniform intervals. Intermediary cavities 5 are formed between adjacent bars 4 into which intermediary cavities a centrally arranged hydraulic valve that is illustrated in more detail in FIG. 2 introduces a pressure medium. Between adjacent bars 4 blades 6 extend which radially protrude in outward direction from a cylindrical rotor hub 7 of a rotor 8. The blades 6 divide the intermediary cavities 5 between the bars 4 respectively into two pressure cavities 9 and 10. A first pressure cavity 9 is associated with an adjustment in a direction "early", whereas a second pressure cavity is associated with an adjustment in a direction "late".

The bars 4 contact an exterior enveloping surface of the rotor hub 7 with their faces in a sealing manner. The blades 6 in turn contact the cylindrical wall of the stator base element 3 with their faces in a sealing manner.

The rotor 8 is connected torque proof with the cam shaft 18. In order to change an angular position between the cam shaft 18 and the drive gear 2 the rotor 8 is rotated relative to the stator 1. For this purpose the pressure medium in the pressure cavities 9 or 10 is pressurized as a function of the respectively intended direction of rotation, whereas the respective other pressure cavities 10 or 9 are unloaded towards the tank T. In order to pivot the rotor 8 counter clockwise into the illustrated position the hydraulic valve pressurizes an annular first rotor channel in the rotor hub 7. From the first rotor channel additional channels 11 lead into the pressure cavities 10. This first rotor channel is associated with the first operating connection A. In order to rotate the rotor 8 clockwise the hydraulic valve pressurizes a second annular rotor channel in the rotor hub 7 wherein the channels 13 open into the second annular rotor channel. The second rotor channel is associated with the second operating connection B. The two rotor channels are arranged axially offset from one another with respect to a central axis 22 so that the two rotor channels are arranged behind one another in the drawing plane 1 so that one covers the other.

The cam phaser 14 is placed onto the cam shaft 18 which is configured as a hollow tube 16. Thus, the rotor 8 is placed onto the cam shaft 18. The hollow tube 16 includes bore holes which hydraulically connect rotor channels associated with the two operating connections A, B with transversal bore holes in a bushing of the hydraulic valve.

Thus the cam phaser 14 is pivotable using the hydraulic valve.

Figure 2:
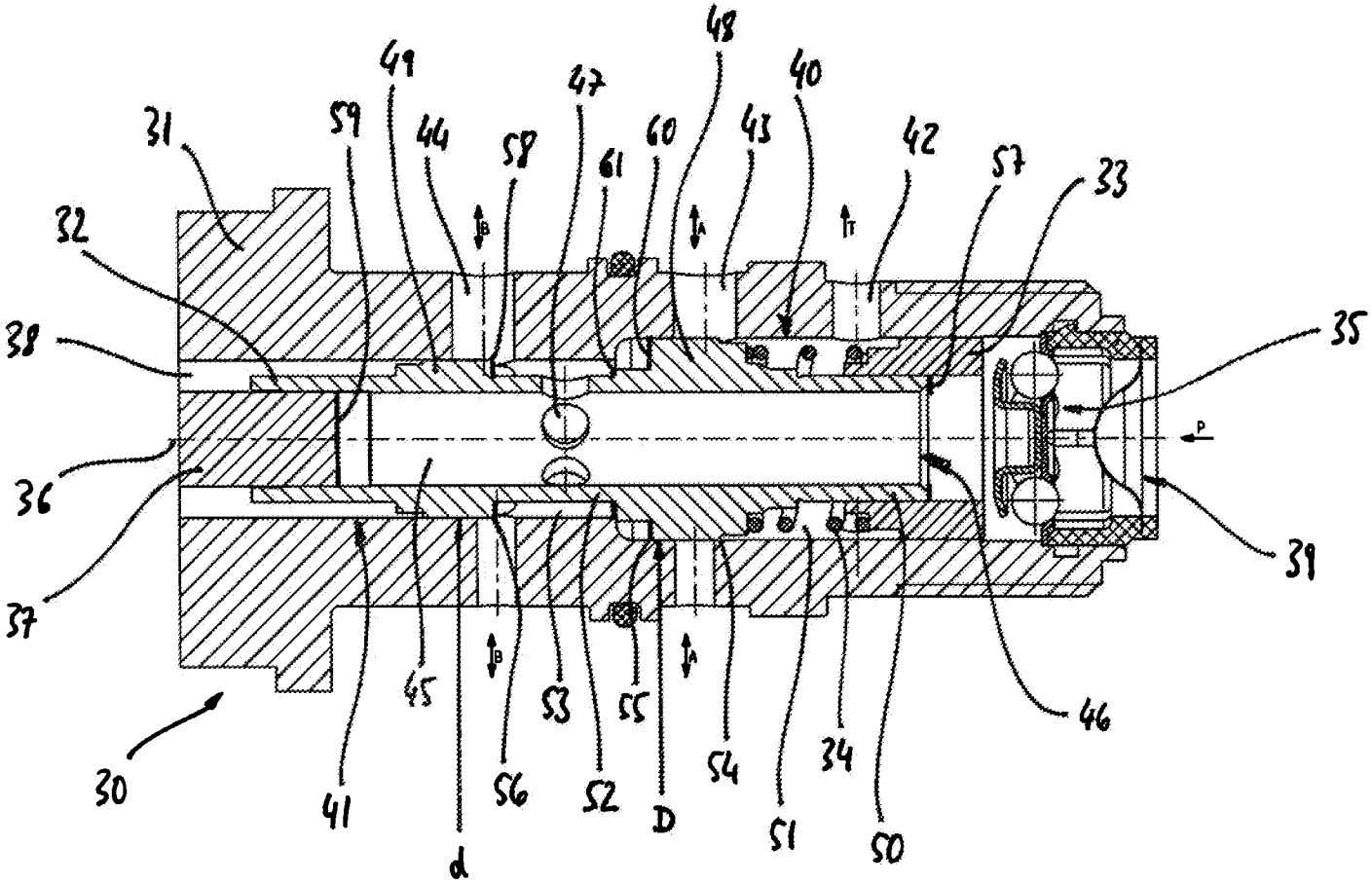
FIG. 2 illustrates a sectional view of a hydraulic valve for controlling the cam phaser.

FIG. 2 illustrates a hydraulic valve 30 for controlling a cam phaser like the cam phaser 14 according to FIG. 1. The hydraulic valve 30 includes a bushing element 31. The hydraulic valve 30 includes a hollow piston 32. The hydraulic valve 30 includes a support element 33. The hydraulic valve 30 includes a spring 34. The hydraulic valve 30 includes a check valve 35. The hydraulic valve 30 includes a longitudinal axis 36. The hollow piston 32 is axially moveable within limits relative to the bushing element 31 between a first end position and a second end position. The hollow piston is loaded by the spring 34 in a direction of the first end position. An actuator 37 is used for loading the hollow piston 32 against a force of the spring 34 in a direction towards the second end positon. The hydraulic valve 30 includes a pressure connection P, a tank connection T, a first operating connection A and a second operating connection B. The operating connections A, B are used for hydraulically connecting with the pressure cavities of a cam phaser like e.g. pressure cavities 9, 10 of a cam phaser according to FIG. 1.

The bushing element 31 includes a center longitudinal channel 38. The longitudinal channel 38 extends along the longitudinal axis 36. The longitudinal channel 38 includes an axial opening 39. The longitudinal channel 38 includes a first channel section 40 with a larger inner diameter D and a second channel section 41 with a smaller inner diameter d. The first channel section 40 is arranged at a side of the longitudinal channel 38 at which the opening 39 is arranged. The longitudinal channel 38 includes a shoulder between the first channel section 40 and the second channel section 41. The pressure connection P of the hydraulic valve 30 is associated with the opening 39. The bushing element includes transversal channels 42, 43, 44. The transversal channels 42, 43 are arranged at the first channel section 40 of the longitudinal channel 38. A tank connection T of the hydraulic valve 3 is associated with the transversal channel 42. The first operating connection A of the hydraulic valve 30 is associated with the transversal channel 43. The transversal channel 44 is arranged at the second channel section 41 of the longitudinal channel 38. The second operating connection B of the hydraulic valve 30 is associated with the transversal channel 44. Viewed from the pressure connection P the tank connection T follows in axial direction, followed by the first operating connection A followed by the second operating connection B.

A groove for receiving a seal is arranged at a radial outside at the bushing element 31. The groove is arranged in axial direction between the transversal channels 43, 44. The bushing element 31 has an external thread at an end oriented towards the pressure connection P. At an opposite end the bushing element 31 includes a collar section.

The hollow piston 32 is arranged within the bushing element 31. The hollow piston 32 includes a central longitudinal channel 45. The longitudinal channel extends along the longitudinal axis 36. The longitudinal channel 45 includes an axial opening 46. At its opposite end the longitudinal channel 45 is closed. The hollow piston 32 includes transversal channels like e.g. 47. The hollow piston 32 has different diameters on its radial outside. The hollow piston 32 has an exterior diameter with plural shoulders. The hollow piston 32 includes a first piston section 48, whose exterior diameter D corresponds to an inner diameter of the first channel section 40 of the longitudinal channel 38 of the bushing element 31. The first piston section 48 of the hollow piston 32 has a shape of an annular bar. The hollow piston 32 is supported tightly sealed with its first piston section 48 at the first channel section 40 of the longitudinal channel 38 of the bushing element 31. The hollow piston 32 includes a second piston section 49, whose exterior diameter d corresponds to an interior diameter of the second channel section 41 of the longitudinal channel 38 of the bushing element 31. The second piston section 49 of the hollow piston 32 is shaped as an annular bar. The hollow piston 32 is supported tightly sealed with its second piston section 49 at the second channel section 41 of the longitudinal channel 38 of the bushing element 31.

At an end oriented towards the opening 46 the hollow piston 42 includes a piston section 50 with an exterior diameter that is smaller compared to the diameter of the first piston section 48. A shoulder is formed between the piston sections 48, 50 which serves as an axial contact surface for the spring 34. A first annular cavity 51 is formed between the piston sections 48, 50. Axially between the first piston section 48 and the second piston section 49 the hollow piston 32 includes a third piston section 52 with an exterior diameter that is smaller than the diameter of the second piston section 49. The third piston section 52 has a shoulder. Between the first piston section 48 and the second piston section 49 a second annular cavity 53 is formed which is connected with the longitudinal channel 45 through the transversal channels 47.

The hollow piston 42 includes control edges 54, 55, 56. The control edges 54, 55 are arranged at the first piston section 48 of the hollow piston 42. The control edges 54, 55 are oriented axially away from each other. The control edges 54, 55 communicate with the transversal channel 43 of the bushing element 31. The control edge 56 is arranged at the second piston section 49 of the hollow piston 32. The control edge 56 is oriented axially against the control edge 55. The control edge 56 communicates with the transversal channel 44 of the bushing element 31.

The hollow piston 32 includes first pressure surfaces 57, 58, 59 and second pressure surfaces 60, 61. The pressure surfaces are axially oriented surfaces. The first pressure surfaces 57, 58, 59 and the second pressure surfaces 60, 61 are oriented against each other. The first pressure surfaces 57, 58, 59 have a total surface which corresponds to a total surface of the second pressure surfaces 50, 61. Thus, the hollow piston is pressure balanced. A first pressure surface 57 is arranged at an end of the hollow piston 32 at which end the opening 46 is arrange. A first pressure surface 58 is arranged at the second piston section 49 of the hollow piston 32 adjacent to the control edge 56 and oriented towards the second annular cavity 53. A first pressure surface 59 is formed at the closed end of the longitudinal channel 45. A second pressure surface 60 is arranged at the first piston section 48 of the hollow piston 32 adjacent to the control edge 55 and oriented towards the second annular cavity 53. A second pressure surface 60 is formed by the shoulder of the third piston section 52.

The support element 33 has a bushing shape. The support element 33 is arranged in the longitudinal channel 38 of the bushing element 31. The support element 33 is arranged at a side of the longitudinal channel 38 oriented towards the opening 39 axially adjacent to the transversal channel 42. The support element 33 is fixated at the bushing element 31. The support element 33 is pressed into the bushing element 31. The spring 34 is supported at the support element 33. The spring 34 is a compression coil spring. An adapted positioning of the support element 33 in the bushing element 31 facilitates adjusting a spring preload. The hollow piston 32 is connected with the actuator 37 at an end of the hollow piston 32 that is arranged opposite to the opening 46. The actuator is an electromagnetic actuator with a push rod which is connected with the hollow piston 32. The push rod is pressed into the hollow piston 32. The push rod closes the longitudinal channel 45 of the hollow piston 32 at an end. The push rod forms a first pressure surface 59 with its longitudinal channel oriented face. Using the actuator 37 the hollow piston 32 is axially moveable against a force of the spring 34 for controlling a flow through between the connection P, T, A, B of the hydraulic valve.

In the first end position the hollow piston 32 is moved to the left with reference to FIG. 2. In the first end position of the hollow piston 32 a pass through is formed between the opening 39 and the transversal channel 34. In the first end position the pressure connection P and the second operating connection B of the hydraulic valve 30 are connected with each other so that fluid is conducted and so that the second operating connection B can be loaded with hydraulic pressure. In the second end position the hollow piston 32 is moved to the right with respect to FIG. 2. In the second end position of the hollow piston 32 a pass through is formed between the opening 39 and the transversal channel 43. In the second end position pressure connection P and the first operating connection A and the first operating connection A of the hydraulic valve 30 are connected with each other in a fluid conducting manner and the first operating connection A can be loaded with a hydraulic pressure.

The check valve 35 is arranged in the opening 39 of the longitudinal channel 38 of the bushing element 31. The check valve 35 is used to facilitate a flow through from the pressure connection P to the operating connection A. B and to block a flow back from the operating connections A, B to the pressure connection P.

REFERENCE NUMERALS AND DESIGNATIONS

1 stator
2 drive gear
3 stator base element
4 bar
5 intermediary space
6 blade
7 rotor hub
8 rotor
9 pressure cavity
10 pressure cavity
11 channel
13 channel
14 cam phaser
16 hollow tube
18 cam shaft
22 central axis
30 hydraulic valve
31 bushing element
32 hollow piston
33 support element
34 spring
35 check valve
36 longitudinal axis
37 actuator
38 longitudinal channel
39 opening
40 first channel section
41 second channel section
42 transversal channel
43 transversal channel
44 transversal channel
45 longitudinal channel

46 opening
47 transversal channel
48 first piston section
49 second piston section
50 piston section
51 first annular cavity
52 third piston section
53 second annular cavity
54 control edge
55 control edge
56 control edge
57 first pressure surface
58 first pressure surface
59 first pressure surface
60 second pressure surface
61 second pressure surface

What is claimed is:

1. A hydraulic valve for a cam phaser, the hydraulic valve, comprising:

a bushing element, including a longitudinal channel, a first transversal channel originating from the longitudinal channel and forming a first operating connection of the hydraulic valve, a second transversal channel originating from the longitudinal channel and forming a second operating connection of the hydraulic valve, a pressure balanced hollow piston arranged within the longitudinal channel axially moveable between a first end position and a second end position, wherein the longitudinal channel includes a first channel section with a larger inner diameter and a second channel section with a smaller inner diameter, wherein the first transversal channel originates from the first channel section and the second transversal channel originates from the second channel section, wherein the hollow piston includes a longitudinal channel with an axial opening, at least one transversal channel, a first piston section with a greater outer diameter and a second piston section with a smaller outer diameter, wherein the hollow piston is supported with a sealing tolerance with its first piston section at the first channel section of the longitudinal channel and supported with a sealing tolerance with its second piston section at the second piston section of the longitudinal channel, and wherein the hollow piston includes plural first pressure surfaces for loading the hollow piston in a direction towards the first end position and plural second pressure surfaces for loading the hollow piston in a direction towards the second end position and a total surface area of the plural first pressure surfaces is substantially equal to a total surface area of the plural second pressure surfaces.

2. The hydraulic valve according to claim 1, wherein the hollow piston includes three first pressure surfaces and two second pressure surfaces.

3. The hydraulic valve according to claim 1, wherein the hollow piston includes a radially recessed third piston section arranged axially between the first piston section and the second piston section, wherein the third piston section forms an annular cavity, and wherein the at least one transversal channel connects the annular cavity with the longitudinal channel of the hollow piston.

4. The hydraulic valve according to claim 3, wherein the hollow piston includes a shoulder at the third piston section of the hollow piston.

5. The hydraulic valve according to claim 3, wherein the hollow piston includes a first pressure surface of the plural first pressure surfaces at a face associated with the axial opening of the hollow piston, a first pressure surface of the plural second pressure surfaces at the first piston section, a second pressure surface of the plural second pressure surfaces at a shoulder of the third piston section, a second pressure surface of the plural first pressure surfaces at the second piston section, and a third pressure surface of the plural first pressure surfaces at a closed end of the longitudinal channel.

6. The hydraulic valve according to claim 1, wherein the longitudinal channel of the hollow piston is closed at an end that is arranged opposite to the axial opening of the hollow piston.

7. The hydraulic valve according to claim 1, wherein the bushing element includes an axial opening, and wherein the first transversal channel originates from the axial opening and axially thereafter the second transversal channel originates from the axial opening.

8. The hydraulic valve according to claim 7, wherein a third transversal channel is arranged axially between the opening of the bushing element and the first transversal channel.

9. The hydraulic valve according to claim 7, wherein a check valve is arranged in the opening of the bushing element.

10. The hydraulic valve according to claim 7, wherein a pressure connection is associated with the opening of the bushing element, the first operating connection is associated with the first transversal channel, the second operating connection is associated with the second transversal channel, and a tank connects associated with the third transversal channel.

11. A cam phaser including a stator and a rotor that is rotatable relative to the stator between a first end position and a second end position for adjusting a cam shaft of an internal combustion engine, wherein the cam phaser includes the hydraulic valve according to claim 1 for controlling a rotation of the rotor relative to the stator.

* * * * *